United States Patent [19]

Halbardier, deceased

[11] Patent Number: 4,796,707

[45] Date of Patent: Jan. 10, 1989

[54] APPARATUS FOR SETTING, UNSETTING, AND RETRIEVING A PACKER OR BRIDGE PLUG FROM A SUBTERRANEAN WELL

[75] Inventor: Floyd A. Halbardier, deceased, late of Pasadena, Tex., by Anna L. Halbardier, heiress

[73] Assignee: Baker Hughes Incorporated, Houston, Tex.

[21] Appl. No.: 112,888

[22] Filed: Oct. 23, 1987

Related U.S. Application Data

[63] Continuation-in-part of Ser. No. 877,421, Jun. 23, 1986, Pat. No. 4,708,208.

[51] Int. Cl.[4] ..... E21B 33/127

[52] U.S. Cl. ..... 166/387; 166/123; 166/182; 166/187; 277/34.3

[58] Field of Search ..... 166/123, 181, 182, 187, 166/373, 374, 387; 277/3, 34, 34.3, 34.6

[56] References Cited

U.S. PATENT DOCUMENTS

| | | | |
|---|---|---|---|
| 3,044,553 | 7/1962 | Bradley | 277/34 |
| 3,762,470 | 10/1973 | Eggleston | 166/182 |
| 3,912,014 | 10/1975 | Wetzel | 166/240 |
| 4,003,581 | 1/1977 | Hutchison | 166/187 |
| 4,082,298 | 4/1978 | Sanford | 277/34.3 |
| 4,163,562 | 8/1979 | Sanford | 277/34.3 |
| 4,566,535 | 1/1986 | Sanford | 166/152 |

*Primary Examiner*—George A. Suchfield
*Assistant Examiner*—Terry Lee Melius
*Attorney, Agent, or Firm*—Hubbard, Thurman, Turner & Tucker

[57] ABSTRACT

An apparatus is provided for running in, actuating, and retrieving an inflatable packer or bridge plug of the type which may be passed through a small diameter tubing, sealed against a large diameter well casing by passing fluid to the packer through a remedial tubing to inflate an elastomeric packing element, and then be retrieved to the surface through the small diameter tubing by deflating the elastomeric packing element. Circulation may be maintained during run-in through an open port in a centralizer member provided on the bottom of the packer or bridge plug. If the device is used as a bridge plug, the open port is closed by a sleeve valve which in turn is actuated by a secondary mandrel extending to the top of the tool for removal by wireline. Removal of the secondary mandrel prior to deflation opens a second port in the centralizing member providing equalization of pressure above and below the inflated elastomeric element. The primary mandrel of the tool is positively secured to the body of the tool by a collet which is released by upward movement of a connector device which has a lost motion connection with the primary mandrel.

19 Claims, 12 Drawing Sheets

APPARATUS FOR SETTING, UNSETTING, AND RETRIEVING A PACKER OR BRIDGE PLUG FROM A SUBTERRANEAN WELL

This application constitutes a continuation-in-part of co-pending application Ser. No. 877,421, filed June 23, 1986, now U.S. Pat. No. 4,708,208, and assigned to the Assignee of this application.

BACKGROUND OF THE INVENTION

1. Field of the Invention

The present invention relates to an apparatus for setting, unsetting, and retrieving an inflatable packer or bridge plug in a subterranean oil or gas well by using coiled tubing or remedial tubing for pumping fluids to the packer. More particularly, the invention relates to an improved apparatus for running in, setting, and retrieving an inflatable packer or bridge plug sized to set in a large diameter casing by passing the packer or bridge plug through a relatively small diameter production tubing by the use of continuous coiled remedial tubing.

2. Description of the Prior Art

Those skilled in the art relating to remedial operations associated with drilling, production, and completion of subterranean oil and gas wells have long utilized threaded remedial tubing inserted through production tubing for running in and setting an inflatable packer in engagement with the bore of a large diameter casing extending below the production tubing. More recently, continuous coiled remedial tubing has replaced threaded tubing, since coiled tubing may be more rapidly inserted into the well and may be easily passed through production tubing and related downhole equipment because its diameter is consistently the same size.

Typical remedial coiled tubing apparatus is described in the 1973 Composite Catalogue of Oil Field Equipment and Services, at page 662 (Gulf Publishing Co., Houston, Tex.), and manufactured by BOWEN TOOLS, INC. of Houston, Tex. Apparatus relating to this coiled tubing technique is more particularly described in U.S. Pat. Nos.: 3,182,877 and 3,614,019.

The need frequently arises in remedial or stimulation operations to pass an inflatable packer or bridge plug through small diameter restrictions; e.g., 3½ inch production tubing, then inflate the packer in a relatively large diameter casing; e.g.; 7-inch casing, subsequently deflate the packer or bridge plug, and then retrieve the packer or bridge plug to the surface through the small diameter tubing. Recent advances, such as those disclosed in U.S. Pat. No. 4,349,204 enable inflatable packers or bridge plugs to pass through small diameter tubing, effectively seal with an enlarged-diameter casing, and then be retrievable to the surface through the small diameter tubing.

When it is desired to insert an inflatable bridge plug, a problem arises in maintaining circulation between the tubing bore and the annulus during run-in. Also, fluid pressure above and below the inflated packing element should be equalized prior to initiation of the deflation operation.

Another significant problem in the art relates to the securement of the operating mandrel of the retrievable packer or bridge plug. In prior constructions, such operating mandrel must be moved upwardly by the coiled tubing in order to effect the deflation of the inflatable elements of the inflatable packer or bridge plug. This necessarily means that set screws have to employed to effect the securement of the end of the coiled remedial tubing to the operating mandrel and thus a definite limit is imposed on the amount of tensile stress that can be placed on the coiled tubing. At the same time, when the inflatable elements are inflated into sealing engagement with the casing wall, and particularly in the case of a bridge plug, a substantial upward force may be exerted on the operating mandrel due to fluid pressure developed in the well.

In the apparatus described in my aforementioned co-pending parent Application, shear screws were utilized to effect the securement of the operating mandrel to the body of the inflatable packer carrying the expanded elastomeric sealing elements. If sufficiently strong shear screws are applied to hold the mandrel to the body against the potential upward pressure forces developed in the well bore, the same shear screws must be sheared by tension applied through the coiled remedial tubing, and this fact severely limits the number and strength of the shear screws employed to anchor the operating mandrel against upwardly directed fluid pressure forces when the retrievable bridge plug or packer is set.

It is accordingly an object of the present invention to overcome the aforementioned deficiencies of retrievable bridge plugs or packers utilizing inflatable packing elements.

SUMMARY OF THE INVENTION

An improved method and apparatus are provided for setting and unsetting an inflatable packer or bridge plug of the type which is secured to remedial tubing and passed through a small diameter tubing string while permitting circulation, and then expanded to seal against a relatively large diameter casing. To retrieve, pressure is equalized across the inflatable sealing element, the sealing element is deflated, and the entire apparatus is then retrieved to the surface. The term "packing tool" will hereinafter be utilized to designate either a packer or bridge plug.

A centralizer is secured to the bottom end of the packing tool and has radial circulation ports maintaining communication between the tubing bore and the annulus surrounding the tubing during run-in of the packing tool. A secondary mandrel extending the full length of the tool is telescopically inserted within the bore of the primary operating mandrel of the tool. A circulating valve is mounted in abutting relationship to the bottom of the secondary mandrel and, during run-in, the circulating valve maintains the circulation ports in the centralizer in an open position to maintain circulation.

The secondary mandrel is provided with an internal, upwardly facing ball seat upon which a ball is dropped after the tool is inserted in the well to the desired position. Pressure is then built up through the bore of the remedial tubing string supporting the tool, and such pressure forces the secondary mandrel downwardly to close the circulating valve which is then locked in the closed position. Such downward movement of the secondary mandrel does not, however, open a second set of radial ports in the centralizer, which, as hereinafter described, constitute means for equalizing the pressure above and below the packing tool when deflation of the tool is desired.

A further increase in the tubing pressure is supplied to a conventional valving chamber for an inflatable packer comprising a check valve and a delayed inflation valve which is shearably secured in a closed position. The increase in tubing pressure effects the shearing of pins holding the delayed inflate valve in its closed position, thus permitting fluid to flow from the inlet chamber to the main inflation chamber provided around the body of the inflatable packer element and underlying an expandable elastomeric element which is inflated into sealing engagement with the casing wall by the applied fluid pressure. The check valve traps the inflation pressure so that the inflatable elastomeric element remains in its inflated condition until subsequent movement of the primary or inflation control mandrel traversing the body of the inflatable packer effects the bleed off of pressure from within the inflated elastomeric element.

In accordance with this invention, the inflation control mandrel is secured in its run-in position, which permits the inflation of the elastomeric packing element, by a collet having a ring portion secured to the body of the inflatable packer and locking heads engaging the inflation control mandrel. Such collet is secured in its locking position by a connecting sleeve, which in turn is connected by a hydraulic disconnect mechanism to the lower end of the remedial coiled tubing.

Two separate procedures may be utilized to effect the deflation of the expanded inflatable tool. An upward force is applied to the coiled tubing which effects the shearing of light weight pins holding the connecting sleeve in engagement with the collet heads and permitting such collet heads to move outwardly out of engagement with the inflation control mandrel. A lost motion connection then abuts a shoulder on the inflation control mandrel and raises the mandrel to its deflating position, and the deflated packing element, together with the coiled remedial tubing, is removed from the well.

In a second preferred procedure, additional fluid pressure is applied through the remedial tubing to the hydraulic disconnect mechanism to release the remedial tubing, which is removed from the well exposing the top of the secondary mandrel and the connecting sleeve. A wireline retrieving tool is then lowered into the well to engage a fishing neck provided on the exposed upper end of the secondary mandrel. Such secondary mandrel is removed by wireline and the effect of such removal is to open the equalizing ports in the centralizer, thus equalizing the fluid pressure above and below the inflated elastomeric packing elements.

The top end of the connecting sleeve also defines a fishing neck which is then engaged by a wireline tool to permit an upward force to be applied to the inflation control mandrel. Such force moves the connecting sleeve out of engagement with the collet heads and permits the collet heads to spring outwardly to release the inflation control mandrel for upward movement, which is effected by an internal abutment on the connecting sleeve after a selected lost motion travel sufficient to effect the release of the collet locking heads. The operating mandrel may then be moved upwardly by the wireline to bring longitudinally extending grooves provided on both the upper and lower portions of the operating mandrel into bridging engagement with the seals provided in each end of the body of the inflatable packing tool to effect the release of pressure from the expanded elastomeric element and the collapse of such elastomeric element. The continued upward movement of the operating mandrel by the wireline connecting sleeve will then, through another lost motion connection, retrieve the entire tool from the well, passing through the small diameter tubing string through which the inflatable tool was originally inserted into the well.

The aforedescribed apparatus functions as a bridge plug and maintains the bore of the tool in a sealed condition subsequent the run-in of the tool. The same tool may be readily modified to function as a packer by eliminating the second mandrel, changing the construction of the centralizer to provide an open bore through the centralizer, and shearably mounting a ball receiving annular seat within the centralizer to receive the ball for developing the initial fluid pressure to effect the setting of the inflatable packer. The packer construction has the same advantage mentioned for the bridge plug construction, namely, the upward forces on the inflation control mandrel are absorbed by the locking collet, hence large shear pins between the operating mandrel and the body of the inflatable packer are unnecessary.

Further advantages of the invention will be readily apparent to those skilled in the art from the following detailed description, taken in conjunction with the annexed sheets of drawings, on which is shown several preferred embodiments of the invention.

DETAILED DESCRIPTION OF PREFERRED EMBODIMENT

Figure 1A:
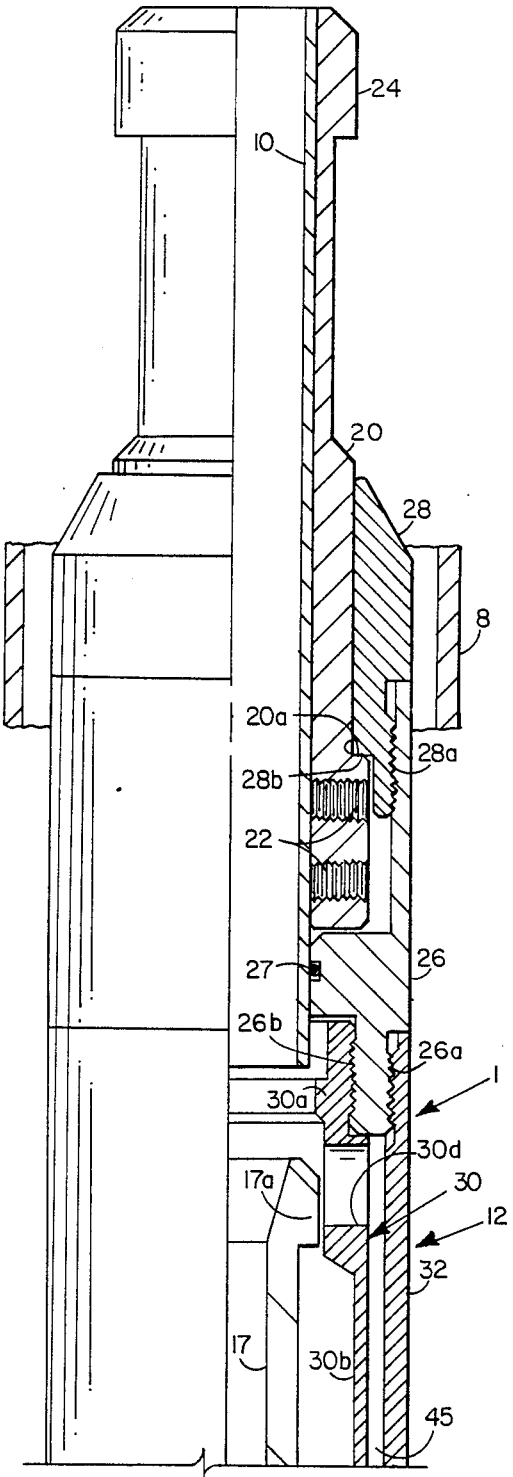
Figs. 1A, 1B, 1C, 1D, 1E and 1F collectively constitute a vertical quarter sectional view showing a packing tool embodying this invention in its run-in position with repsect to a subterranean well.
Figure 1B:
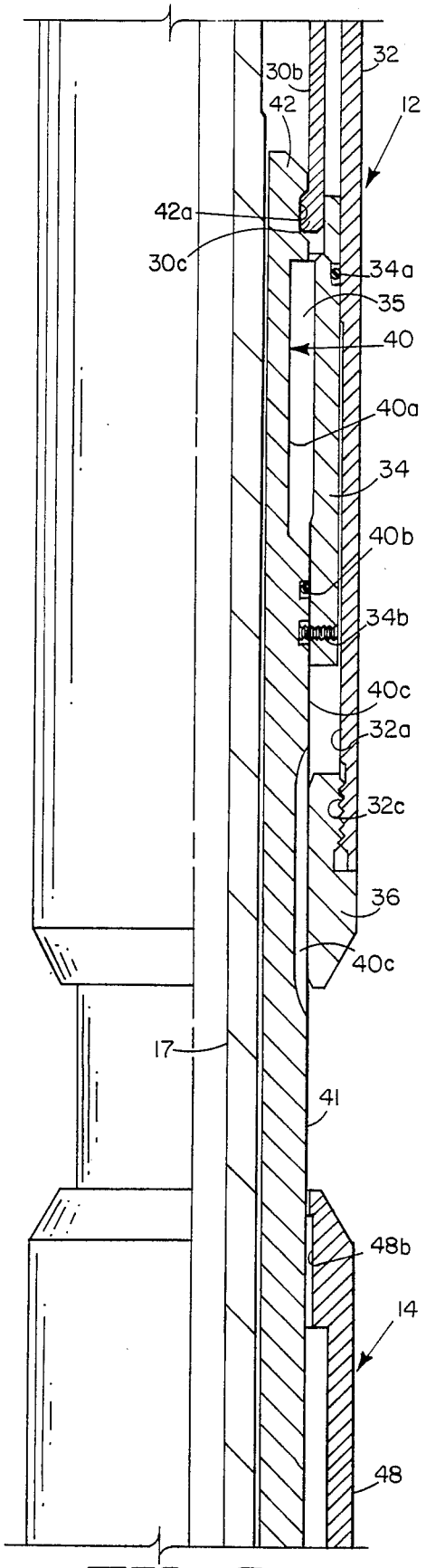
Figure 1C:
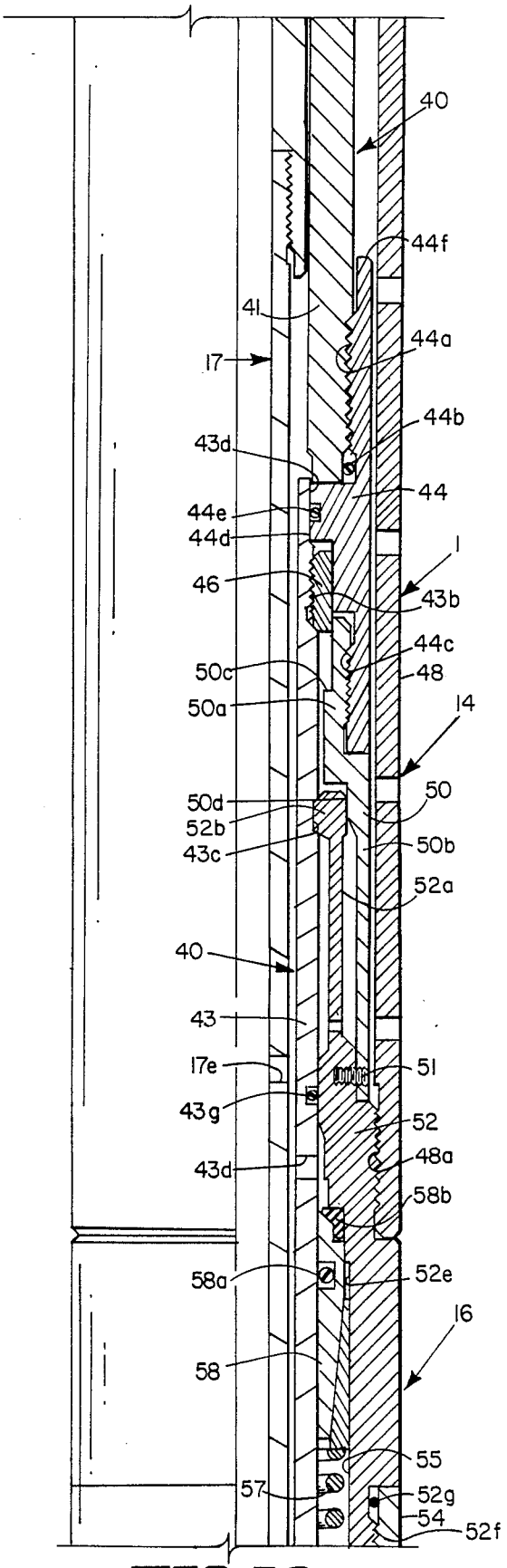
Figure 1D:
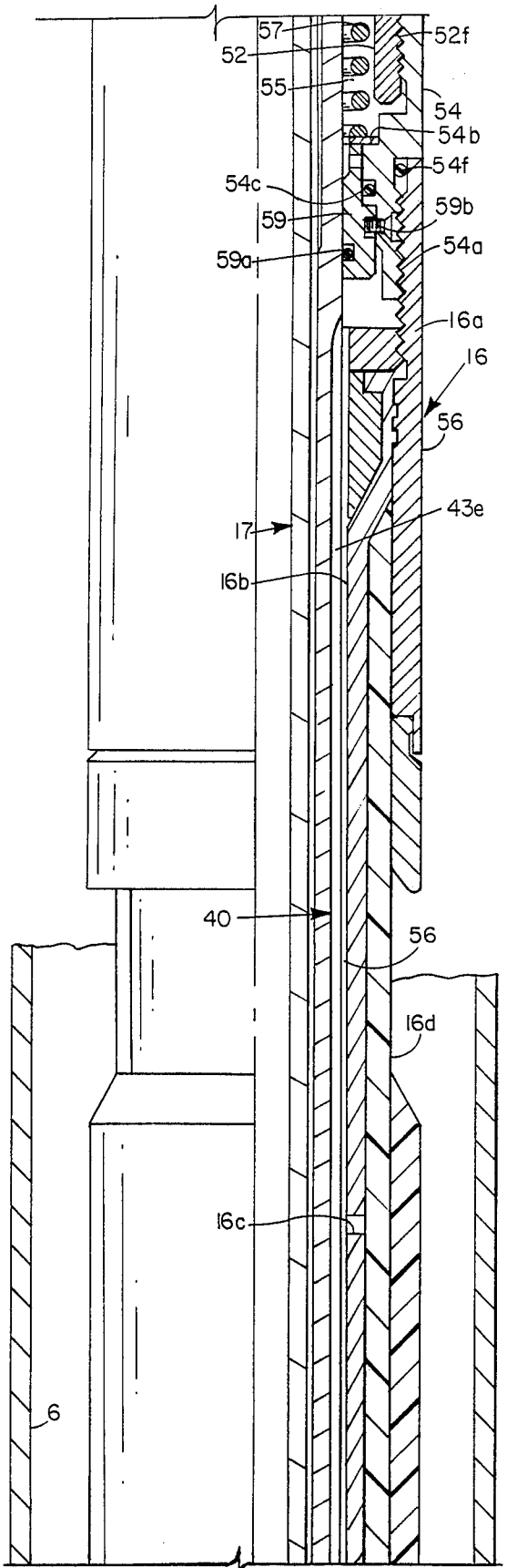
Figure 1E:
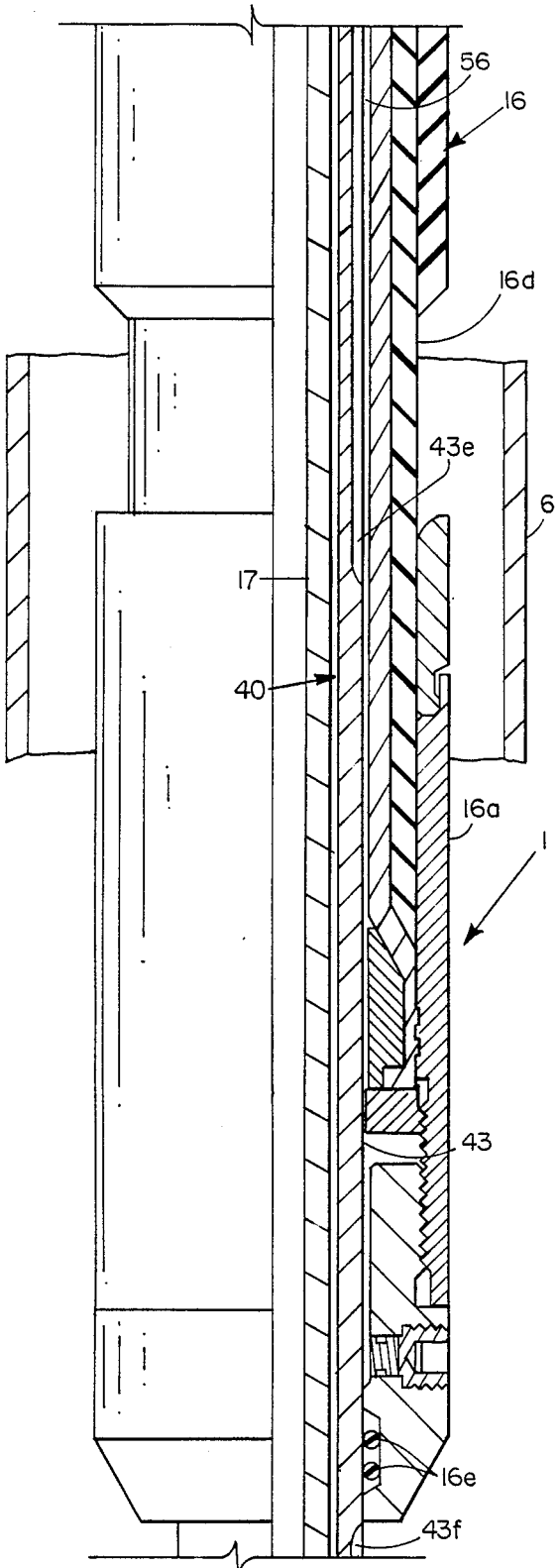
Figure 1F:
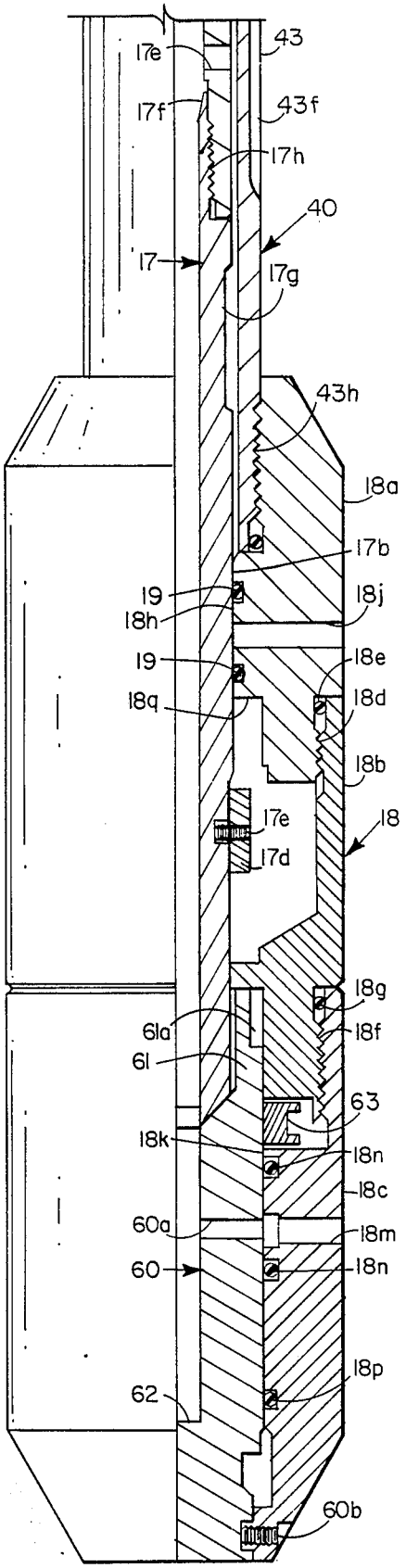

Referring to Figs. 1A, 1, 1C, 1D, 1E, and 1F, there is shown an inflatable packing tool 1 embodying one embodiment of this invention connected to the end of coiled remedial tubing 10. Either coiled tubing 10 or conventional threaded remedial tubing may be utilized to lower the inflatable packing tool 1 to the desired position in the well by passing through the lower end of relatively small diameter production tubing 8 to extend into the open bore of a substantially larger diameter casing 6. The casing 6 is schematically shown in FIG. 1D in reduced scale. The packing tool 1 is inflated so as to effect a seal against the interior bore surface of casing 6, is subsequently deflated or "unset", and then may be retrieved to the surface through the production tubing 8. Inflation of the packing tool 1 is controlled by passing fluid under pressure from the surface to the packing tool actuator assembly through the coiled remedial tubing 10.

The packing tool 1 includes a first tubular connection subassembly 12, a second tubular connection subassembly 14, and an inflatable packer unit 16, described subsequently. A primary or inflation controlling mandrel 40 extends through the inflatable packer unit 16 and an annular centralizing housing 18 is mounted on the lower end of the primary mandrel 40. A secondary mandrel 17 extends through the bore of primary mandrel 40 from the centralizing housing 18 to a point within the first connection subassembly 12, for a purpose to be described.

First connection subassembly 12 includes a top sub 20 interconnected to the remedial tubing 10 by a plurality of set screws 22. A seal sub 26 is secured to external threads **28*a* provided on the bottom end of a gage ring 28. Gage ring 28 defines a downwardly facing internal shoulder 28*b* which engages an upwardly facing external shoulder 20*a* on top sub 20. Seal sub 26 defines an annular groove mounting an 0-ring 27 in sealing engagement with the external periphery of the remedial tubing 10**.

The lower portion of seal sub 26 is provided with external threads **26*a* and internal threads 26*b*. The external threads 26*a* mount a downwardly extending cylinder sleeve 32 while the internal threads 26*b* mount the upper ring portion 30*a* of a collet 30. Collet 30 has downwardly depending, peripherally spaced arm portions 30*b* terminating in inwardly enlarged locking head portions 30*c* which are engagable with a groove 42*a* formed in a fishing neck head portion 42 of the primary mandrel 40**.

The collet head portions **30*c* are retained in engagement with the annular groove 42*a* by an annular locking piston 34 which is slidably and sealably mounted in an annular chamber 35 defined between the internal wall 32*a* of the cylinder sleeve 32 and the external wall 40*a* of the primary mandrel 40. The sealable mounting of the piston 34 is effected by an external O-ring 34*a* engaging the internal wall 32*a* of cylinder sleeve 32 and an internal 0-ring 40*b* mounted in an enlarged cylindrical external surface 40*c* formed on the primary or operating mandrel 40. One or more shear screws 34*b* are provided to secure the piston 34 to mandrel 40 in its locking relationship with respect to the collet heads 30*c***.

The upwardly facing surfaces of piston 34 are exposed to fluid pressure existing within the bore of the remedial tubing 10 through one or more radial ports **30*d* formed in the ring portion of collet 30. The downwardly facing surfaces of piston 34 are exposed to fluid pressure existing externally of the tool 1 through a plurality of peripherally spaced grooves 40*c* formed in the exterior of the primary mandrel 40 and underlying a support ring 36 which is secured to internal threads 32*c* formed in the bottom end of the cylinder sleeve 32**.

From the foregoing description, it will be apparent that when the tubing pressure within the bore of the remedial tubing 10 reaches a level sufficient to effect the shearing of shear screws **34*b*, the piston 34 will be moved downwardly and the collet locking heads 30*c* will be free to spring out, or be cammed out of engagement with the annular groove 42*a*, thus releasing the connector subassembly 12 from its locked engagement with the primary or operating mandrel 40, and permitting the remedial tubing and the connecting subassembly 12 to be retrieved from the well, leaving fishing neck 17*a* on top of secondary mandrel 17, and the fishing neck groove 42*a* on the top end of the primary mandrel 40** exposed for engagement by a wireline tool, as will be subsequently described.

Referring now to FIG. 1C, it will be noted that the primary or operating mandrel 40 is formed of two major components, respectively an upper tubular part 41 and a lower, tubular part 43 which are interconnected by a lost motion connection including a connection sub 44 disposed within the secondary tubular connection subassembly 14. Connection sub 44 has internal threads **44*a* engaging the bottom end of the upper mandrel part 41. This threaded connection is sealed by an O-ring 44*b*. Additionally, connector sub 44 has an internal rib 44*d* mounting an 0-ring 44*e* which sealingly engages the top external surface 43*d* of lower portion 43 of primary mandrel 40. The lower end of connection sub 44 is provided with internal threads 44*c* which engage external threads provided on a collet locking sleeve 50. Collet locking sleeve 50 has a reduced diameter upper portion 50*a* which defines a lost motion abutting connection with an abutment ring 46 secured to threads 43*b* formed on the upper end of the lower mandrel portion 43. Such abutting connection is defined by an internally projecting, upwardly facing shoulder 50*c* formed on the collet locking sleeve 50**.

The lower enlarged portion **50*b* of the collet locking sleeve 50 defines an internal cylindrical surface 50*d* which is engagable with locking heads 52*b* formed on the ends of peripherally spaced arms 52*a* of a collet 52 which is formed as the top element of the body portion of inflatable packer 16**.

Collet heads **52*b* engage an annular groove 43*c* formed in the lower portion 43 of the primary or operating mandrel 40 and thus effect the locked engagement of the lower mandrel portion 43 to the body of inflatable packer 16. The collet locking sleeve 50 is initially secured in this locking relationship to the collet heads 52*b* by one or more shear screws 51 which traverse the lower end of the collet locking sleeve 50 and threadably engage the solid ring portion of the collet 52**.

To release the collet locking heads **52*b* from their locking engagement with the primary operating mandrel 40, an upward force must be applied to the top end of the mandrel 40 sufficient to effect the shearing of the shear screws 51*c*. After such shearing is accomplished, the lost motion connection between the collet locking sleeve 50 and the abutment ring 46 secured to the lower portion 43 of the operating mandrel 40 will permit the internally enlarged portion 50*d* of the collet locking sleeve 50 to move out of engagement with the collet locking heads 52*b*, permitting such heads to be moved outwardly and thus release the mandrel portion 43 for upward movement with the upper mandrel portion 41 when the upwardly facing shoulder 50*c* on the collet locking sleeve 50 engages the bottom surface of the abutment ring 46**.

Thus, the second connector subassembly 14 lockingly secures the lower portion 43 of the primary mandrel 40 to the body portion of the inflatable packer unit 16. Any upward fluid pressure forces on mandrel portion 43 are absorbed by the collet 52 and not by shear screws. In contrast to the first connection subassembly 12, which is released by fluid pressure supplied through remedial tubing, the second subassembly connection 14 is released by application of an upward force to the upper part 41 of primary mandrel 40.

The second connection subassembly 14 additionally includes a lost motion connection between the inflatable packer 16 and the primary mandrel 41. Such lost motion connection comprises an outer sleeve 48 secured by internal threads 48*a* to the body of collet 52 and extending upwardly a substantial distance above connection sub 44. An internally enlarged portion 48*b* (FIG. 1B) is provided on the top end of outer sleeve 48 to project into the path of top surface 44*f* of connector sub 44 as primary mandrel 40 is raised, thereby accomplishing the retrieval of collet 52 and the inflatable packer 16 secured thereto.

The lower end of collet 52 is provided with external threads 52*f* to which is secured an intermediate sub 54. An O-ring 52*g* seals the threaded connection. Intermediate sub 54 in turn is threadably secured by external threads 54*a* (FIG. 1D) to the top portions of the body assembly 16*a* of the inflatable packer 16. 0-ring 54*f* seals these threads.

The internal surfaces of the lower portion of collet 52 and the intermediate sub 54 are both radially spaced from the external surface of the lower part 43 of the primary mandrel 40, thus defining a valving chamber 55. 0-ring 43*g* seals the top end of valving chamber 55. An annular check valve 58 (FIG. 1C) is slidably and sealably mounted in the upper end of chamber 55 and is spring biased to a closed position by a compression spring 57 which seats against an upwardly facing surface 54*b* formed on the intermediate sub 54. An O-ring seal 58*a* is mounted in the interior surface of check valve 58 to sealingly engage the exterior surface of lower mandrel part 43 and, additionally, an annular elastomeric sealing element 58*b* is mounted in surrounding relationship to the upper end of the check valve 58 to effect a seal with the internal surface of the collet body 52. Fluid pressure is supplied to the top end of check valve 58 by one or more radial ports 43*d* formed in the lower part 43 of the primary mandrel 40.

An inflation delay valve 59 (FIG. 1D) is slidably and sealably mounted in the lower end of the chamber 55 and sealingly cooperates with an 0-ring 54*c* provided in the internal surface of intermediate sub 54 and mounts an internal 0-ring 59*a* which sealingly cooperates with the external surface of the lower part 43 of the primary mandrel 40. Inflation delay valve 59 is shearably secured in its flow-blocking position in the chamber 55 by one or more shear screws 59*b*. Thus, when sufficient fluid pressure is supplied through the remedial tubing 10 to overcome the spring bias on check valve 58 and effect the shearing of shear screws 59*b*, both the check valve 58 and the inflation delay valve 59 will be moved downwardly to occupy positions permitting free fluid flow into an annulus 56 defined between the tubular body portion 16*b* of the inflatable packer 16 and the exterior of the surface of the lower part 43 of the primary mandrel 40.

Figure 2A:
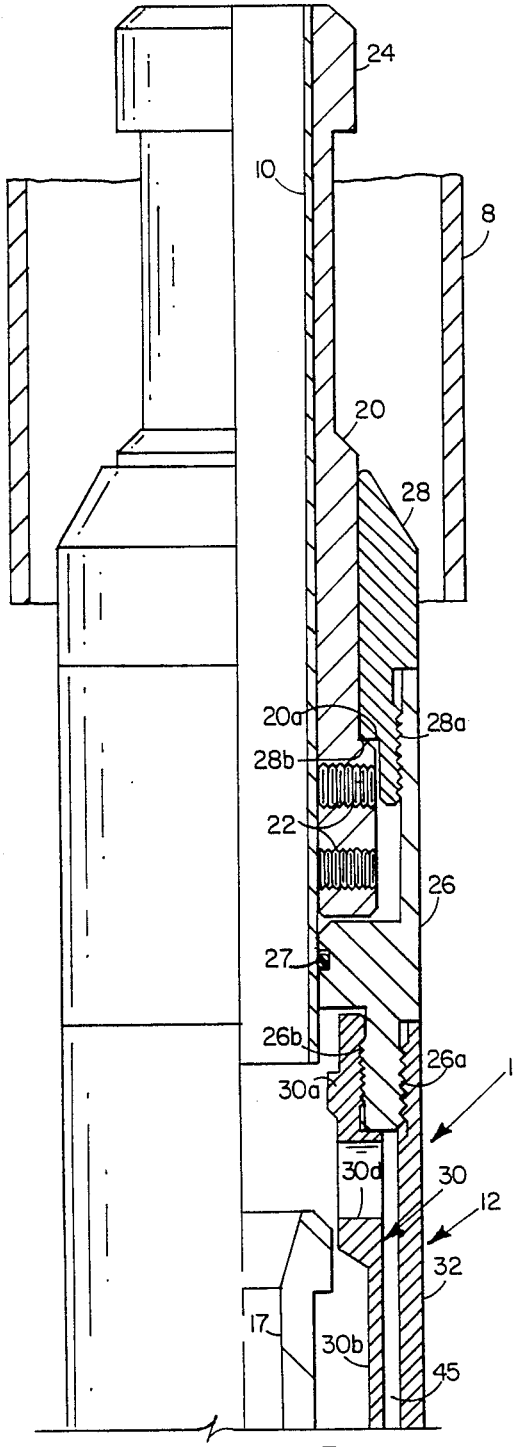
FIGS. 2A, 2B, 2C, 2D, 2E , and 2F are views respectively similar to Figs. 1A, 1B, 1C, 1D, 1E, and 1F, but showing the position of the inflatable elements of the packing tool when expanded to engage the casing of the well.
Figure 2B:
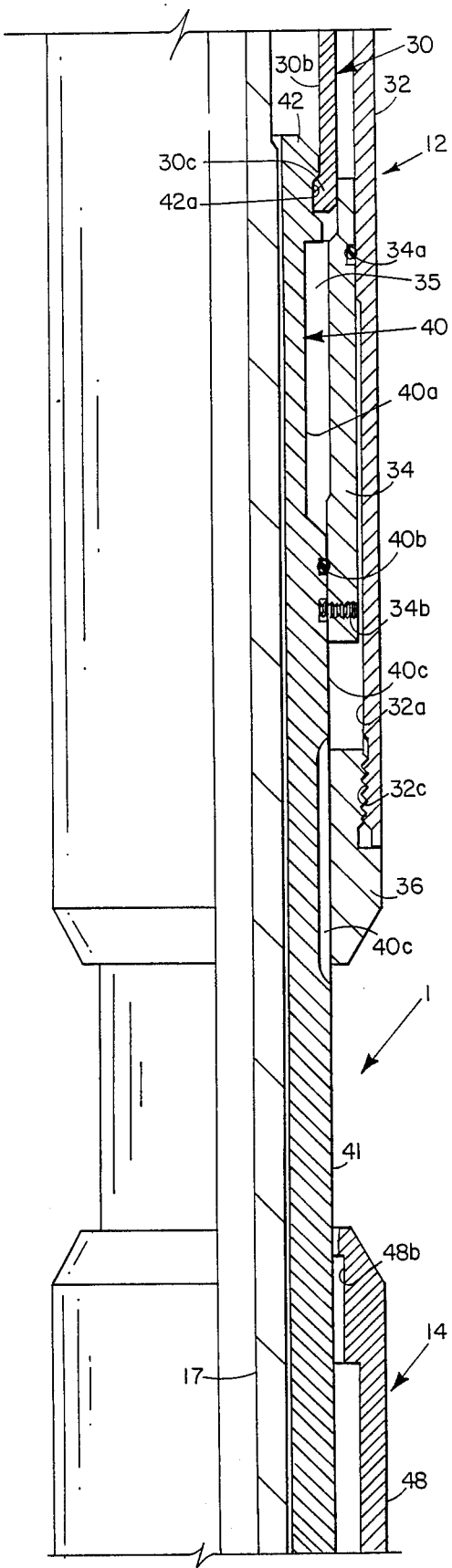
Figure 2C:
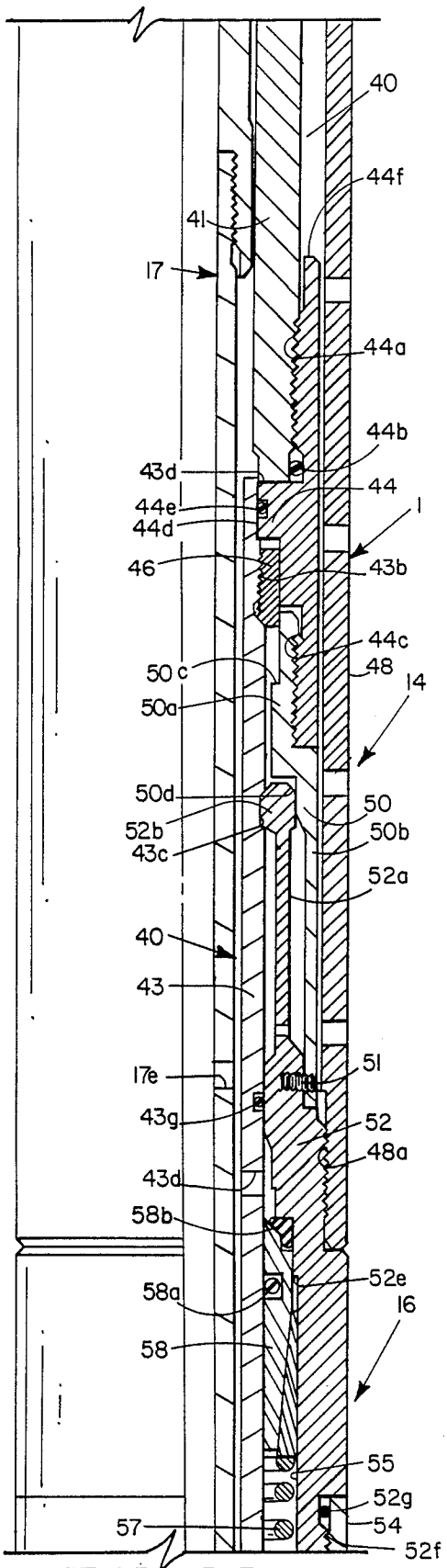
Figure 2D:
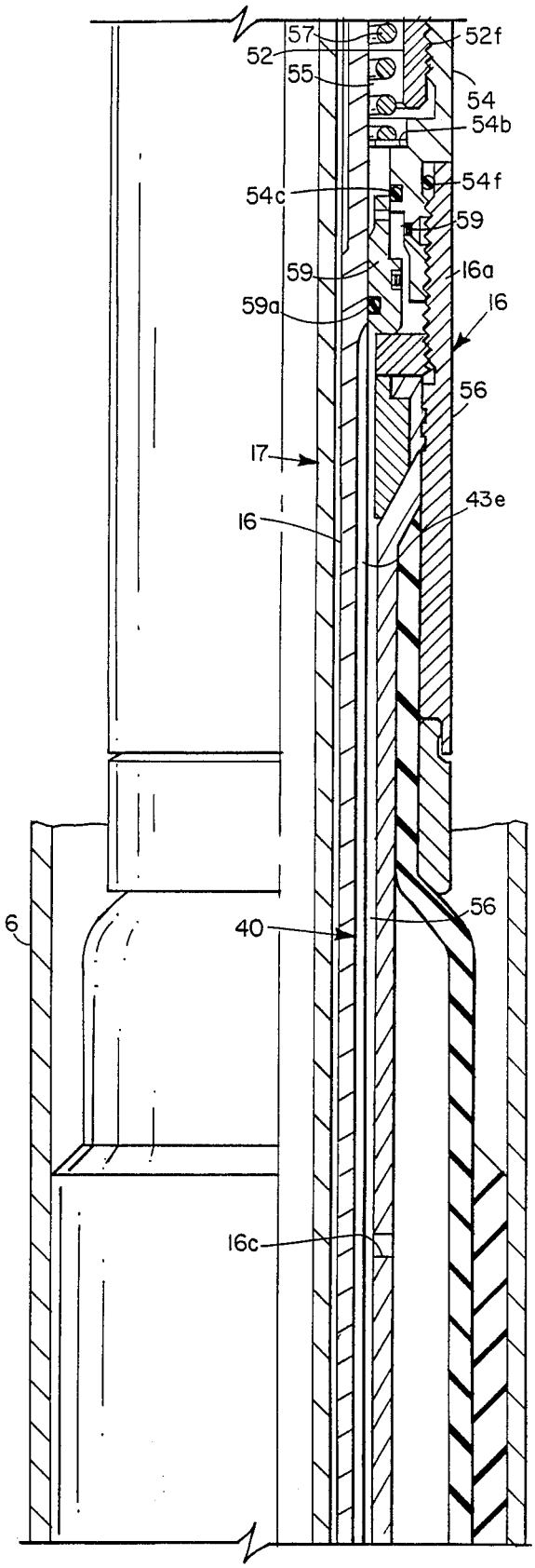
Figure 2E:
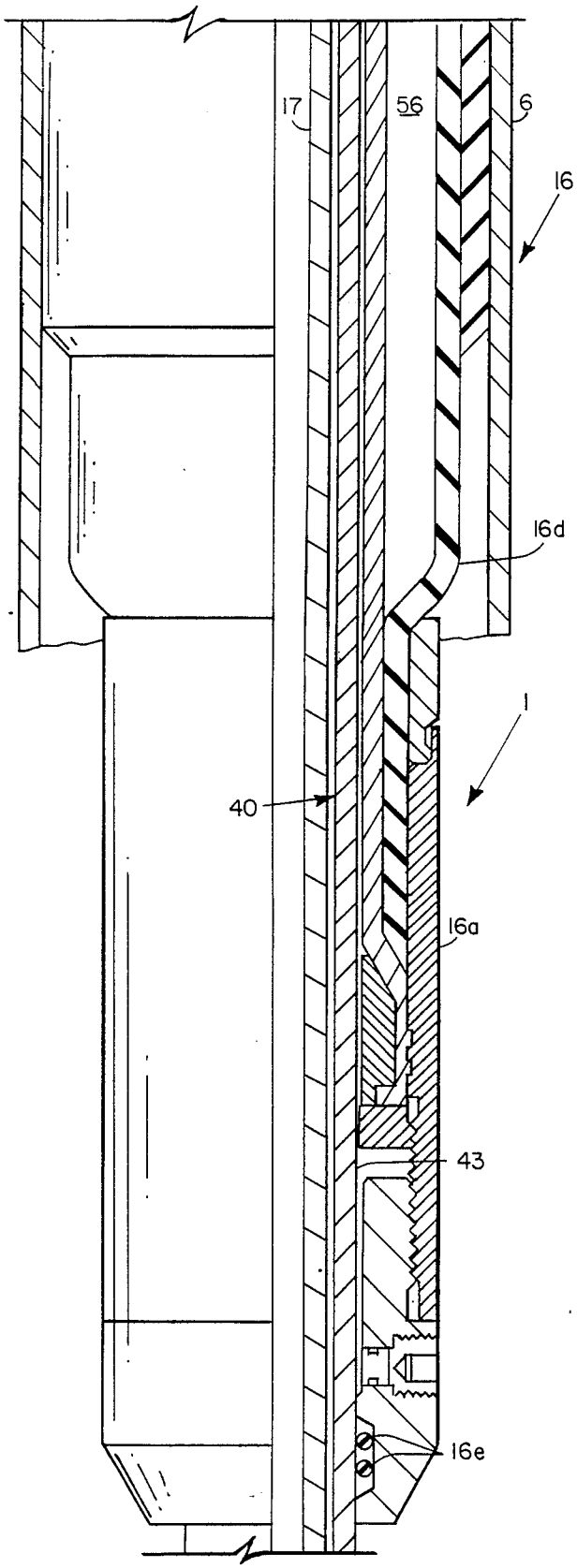

Inflatable packer 16 is of entirely conventional construction and incorporates an expandable elastomeric element 16*d* which has its axial end portions secured by the body assembly 16*a* its medial portions are inflatable by the internally applied fluid pressure into sealing engagement with the interior bore of the casing 6, as illustrated in FIGS. 2D and 2E. The inflatable packer 16, the check valve 58 and the inflation valve 59 are identical to corresponding elements described in the aforementioned parent application, hence further description of these elements is deemed unnecessary.

It should be noted that the bottom end of the inflatable packer 16 incorporates 0-ring seals 16*e* which sealingly engage the exterior surface of the lower part 43 of the primary mandrel 40. Once the expandable elastomeric element 16*d* of inflatable packer 16 has been expanded by the applied fluid pressure, it will remain in such expanded condition due to the closing of the check valve 58 under the bias of spring 57.

Deflation of the expanded elastomeric element 16*a* can only be accomplished by shifting the lower part 43 of the primary mandrel 40 upwardly. Such upward movement of the primary mandrel 40 brings two axially spaced, longitudinally grooved portions 43*e* and 43*f* of mandrel 43 respectively to bridging engagement with seal 58*a* in the check valve 58 and the O-ring seals 16*e* provided in the lower end of the inflatable packer 16, thus permitting the fluid pressure within the expanded elastomeric element 16*d* to concurrently exhaust through both the upper and lower ends of the inflatable packer.

The bottom end of lower part 43 of primary mandrel 40 is provided with external threads 43*h* and these threads are engaged by the tubular centralizing element 18. Centralizing element 18 comprises a threaded assemblage of three components, namely, an upper portion 18*a*, an intermediate or connecting portion 18*b* and a lower portion 18*c*. Threads 18*d* and O-ring 18*e* provide the connection between the upper part 18*a* and intermediate part 18*b*, while threads 18*f* and 0-ring 18*g* effect the connection between intermediate part 18*b* and the lower part 18*c*.

Upper part 18*a* defines a cylindrical bore 18*h* with which an external surface 17*b* on the bottom of secondary mandrel 17 is in sliding and sealing relationship. Seals are provided by 0-rings 19 which are respectively disposed above and below a plurality of radial ports 18*j* formed in the upper part 18*a* of the centralizer 18.

The lower end of the intermediate part 18*b* and the lower part 18*c* of the centralizer housing 18 define a cylindrical bore 18*k* within which a valve plug 60 is slidably and sealably mounted. Valve plug 60 has an annular upper portion 61 and a solid bottom portion 62. Annular portion 61 is provided with one or more radial ports 60*a* in annular portion 61 which, in the run-in position of the tool, are axially aligned with a plurality of radial circulation ports 18*m* formed in the bottom portion 18*c* of the centralizer housing 18. O-ring seals 18*n* are provided above and below radial ports 18*m* and an O-ring 18*p* is provided near the bottom of lower housing part 18*c*. Valve plug 60 is held in such position by one or more set screws 60*b*.

When the secondary mandrel 17 is forced downwardly, by means to be hereinafter described, it engages the valve plug 60 and effects the shearing of shear screws 60*b* and moves valve plug 60 downwardly to the position shown in FIG. 2F. In this position, the ports 60*a* in the annular portion 61 of valve plug 60 are no longer axially aligned with the ports 18*m* but are displaced below the lowermost 0-ring 18*n*, thus preventing communication between the annulus surrounding the tool and the internal bore of the tool 1. In this lower position, a contractable C-ring 63, which is mounted between the top end of the lower portion 18*c* and the bottom end of the intermediate portion 18*b*, snaps into engagement with an annular recess 61*a* provided in the top exterior wall of the valve plug 60 and locks the valve plug 60 in such position, thus effectively sealing the bore of the tool 1 from entry of well fluids into such bore and permitting the tool 1 to function as a bridge plug.

When the secondary mandrel 17 is removed from the tool 1, in a manner that will be subsequently described, an annular locating ring 17*d* secured to the periphery of secondary mandrel 17 by a shear screw 17*e* will be shearably released by contact with a downwardly facing surface 18*q* provided on the upper part 18*a* of the centralizer housing 18. The removal of mandrel 17 thus opens one or more radial ports 18*j* to equalize fluid pressure above and below the inflated elastomeric packing element 16*d* as a preliminary step to withdrawing the entire inflatable packer 16 from the well.

While the secondary mandrel 17 has been described as being of unitary construction, reference to the drawings will show that it is more conveniently formed in a plurality of sections which are threadably secured together. No seals are necessary in these connections since a plurality of axially spaced ports 17*e* are formed in the secondary mandrel 17 to maintain the fluid pressure on the inside and outside of the secondary mandrel to always be equal. For this reason, the presence of the secondary mandrel does not interfere with the flow of pressured fluid from the remedial tubing through the inlet port 43*d* for effecting the inflation of the inflatable packer 16.

To effect the required downward movement of the secondary mandrel 17, an upwardly facing ball seating surface 17*f* is formed on such mandrel at a convenient location near the bottom end of the mandrel. For example, the lowermost section 17*g* of the threadably assembled mandrel 17 may be provided with such surface at its upper end immediately adjacent the threaded connection 17*h*. Upon dropping a ball 70 onto the ball seating surface 17*f*, (FIG. 2F) an increase in fluid pressure applied through the remedial tubing 10 will result in a downward force being exerted on the secondary mandrel 17 and the mandrel 17 will be displaced downwardly after shearing set screws 60*b*, thus shifting the valve plug 60 to its lower position and shutting off circulation through the valve plug circulation port 60*a*.

OPERATION

With tool 1 assembled as illustrated in Figs. 1A–1F and as described above, the tool is lowered into the well through a relatively small diameter tubing string, such as a production tubing string 8, to a position below the bottom end of the small diameter tubing string 8. During the insertion of the tool 1 into the well, circulation is maintained through the centralizer housing ports 18*m* and the valve plug ports 60*a*.

When the inflatable packer is lowered to a desired position within the casing 6, the ball 70 is dropped through the coiled tubing and comes to rest on the ball seating surface 17*f*. Pressured fluid is then supplied through the remedial tubing 10 to increase the pressure in the bore of the tubing and in the bore of the tool 1.

Figure 2F:
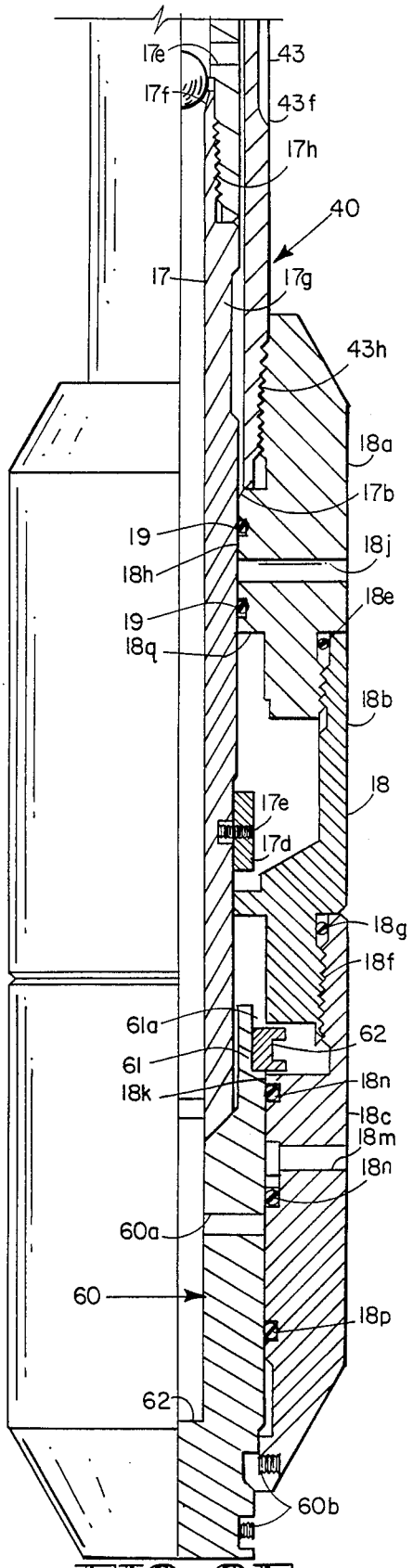

The first effect of such increased pressure is to force the secondary mandrel 17 downwardly, thus shearing the plug valve shear screws 60*b* and forcing the valve plug 60 into its lowermost, locked position shown in FIG. 2F. In this position, the port 60*a* in the valve plug 60 is no longer aligned with the circulation ports 18*m* in the centralizer housing 18 and, thus, circulation is effectively interrupted and the bottom end of the bore of tool 1 is sealed with respect to fluids existing in the well.

A further increase in the fluid pressure being supplied through the remedial tubing 10 will cause the check valve 58 to move downwardly, thereby applying the fluid pressure to the inflate delay valve 59. When the fluid pressure reaches a level sufficient to effect the shearing of shear screws 59*b*, the inflate delay valve 59 is displaced downwardly and the fluid pressure enters the inflatable packer 16 and effects the radial expansion of the inflatable elastomeric element 16*d* of such packer, thus assuming the position shown in FIGS. 2D and 2E.

The tool 1 thus effectively constitutes a bridge plug blocking all fluid communication between the lower portions of the well casing and the bottom end of the production tubing 8.

Figure 3A:
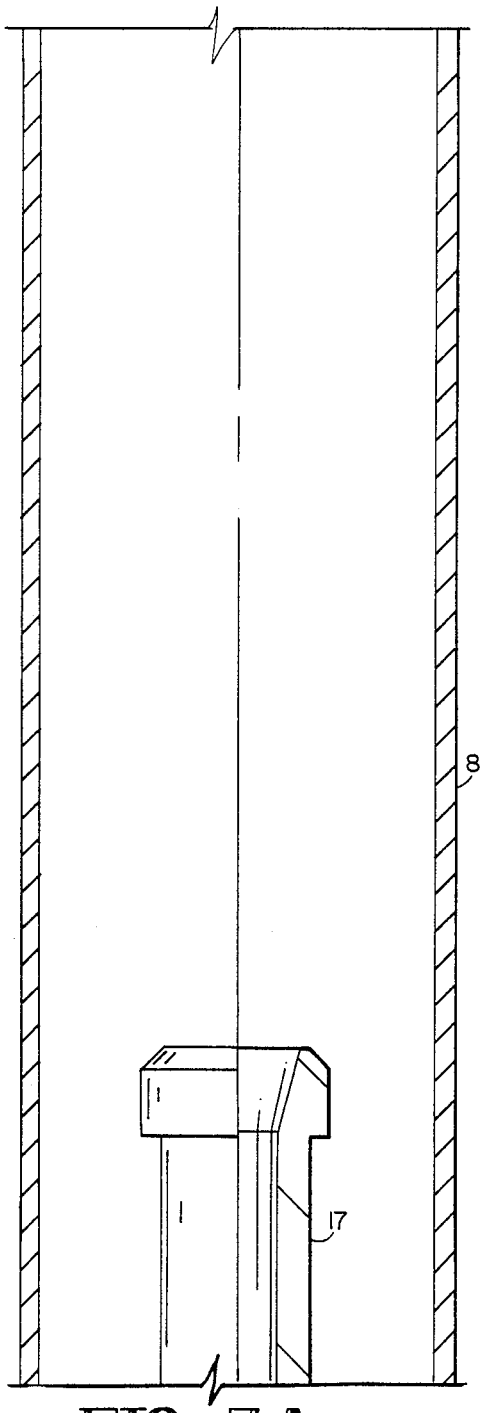
FIGS. 3A and 3B are views respectively similar to FIGS. 1A and 1B but illustrating the release of the coupling mechanism between the packing tool and the remedial tubing.
Figure 3B:
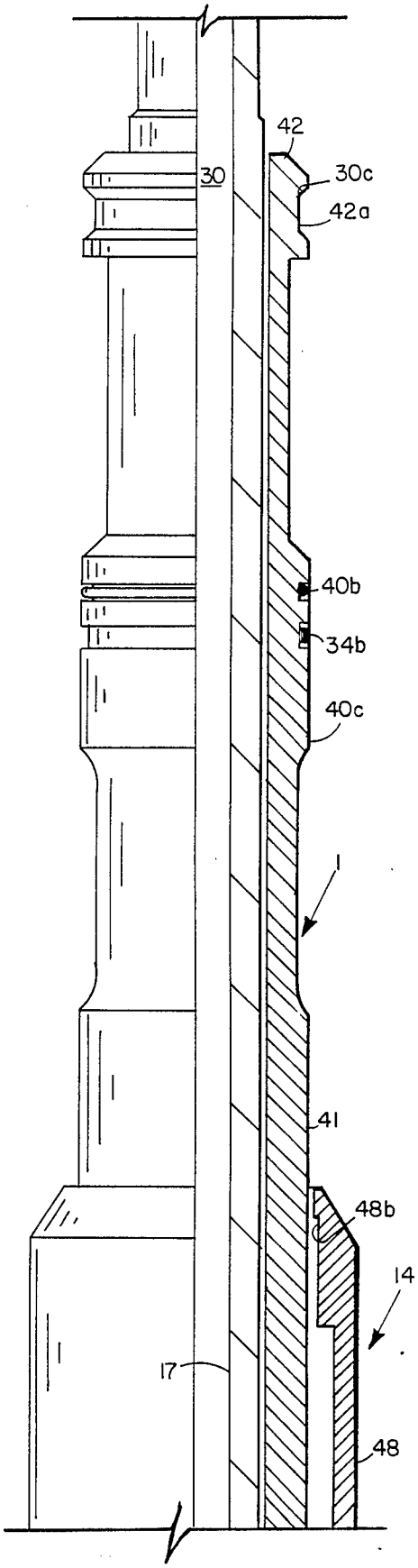
Figure 4B:
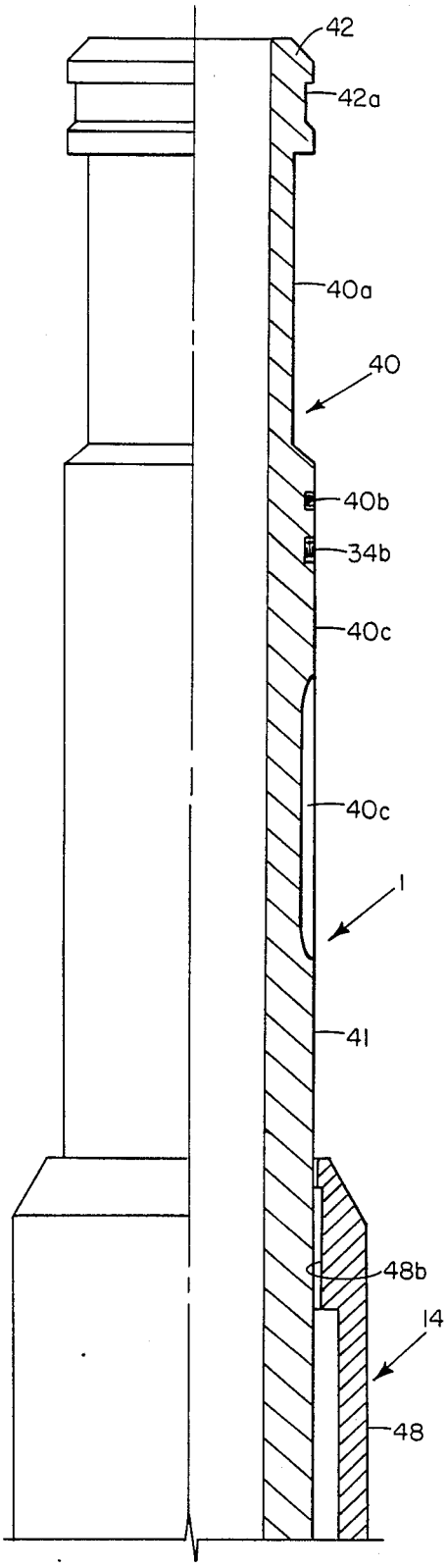
FIGS. 4B, 4C, 4E and 4F are views respectively similar to Figs. 1B, 1C, 1D, 1E, and 1F, but showing the actuating tool with the secondary mandrel removed, preliminary to the deflation of the packing element.
Figure 4C:
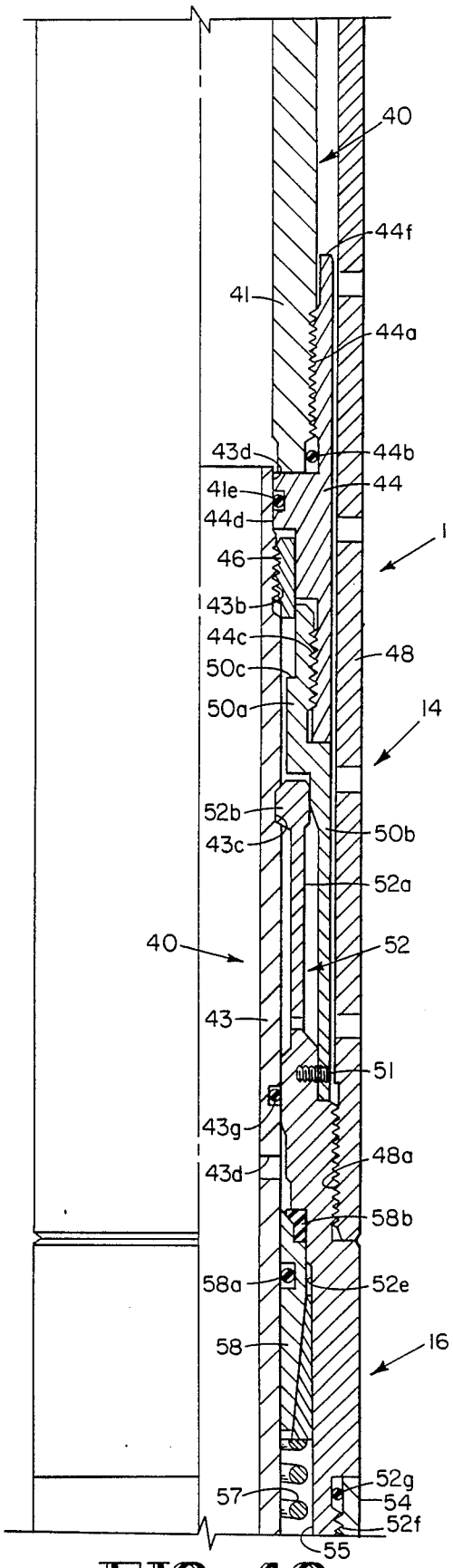
Figure 4D:
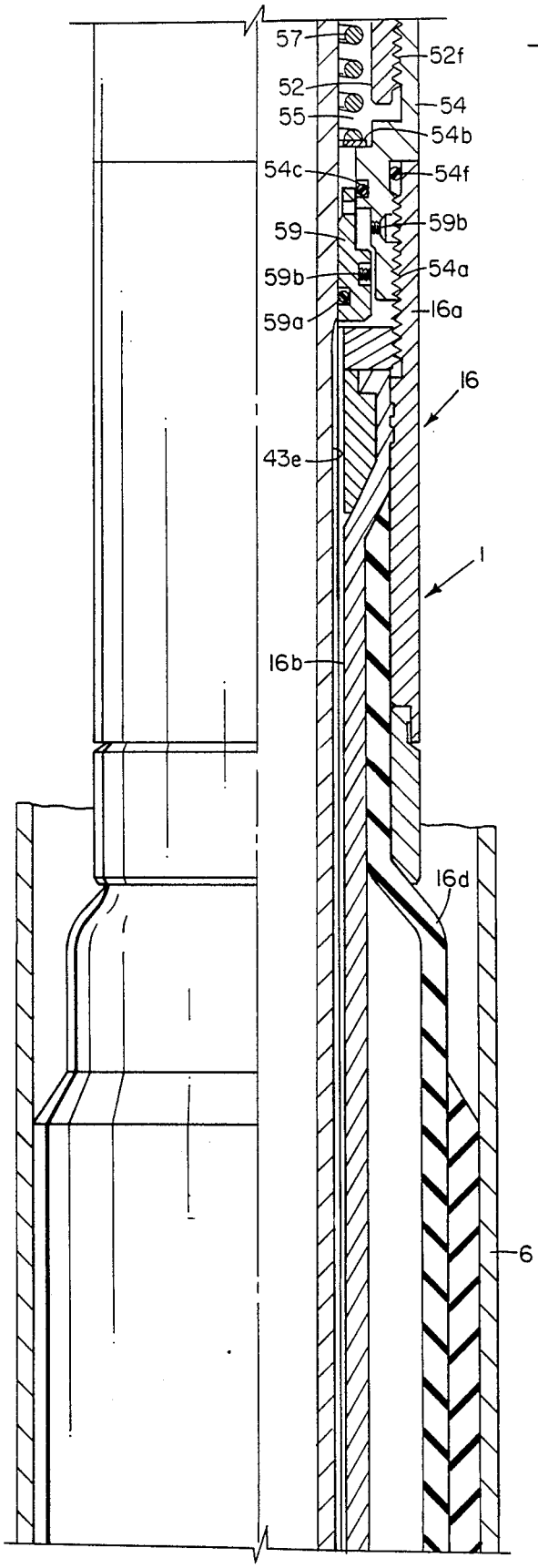
Figure 4E:
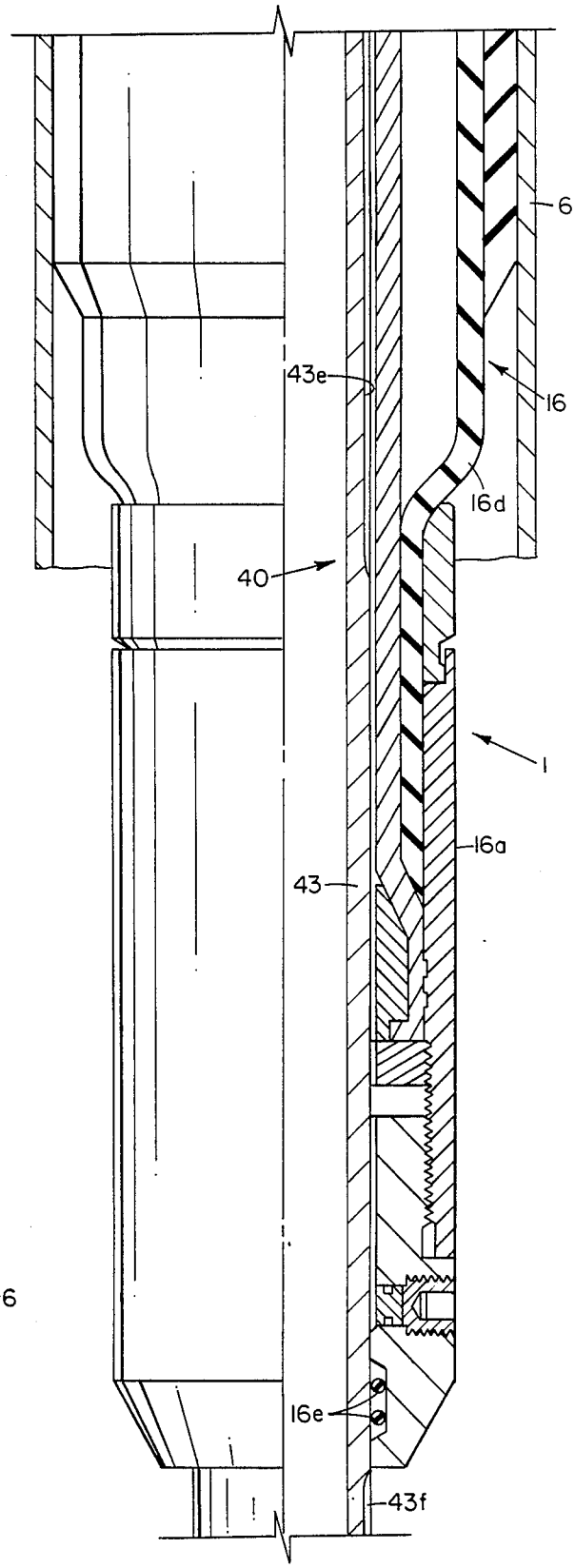
Figure 4F:
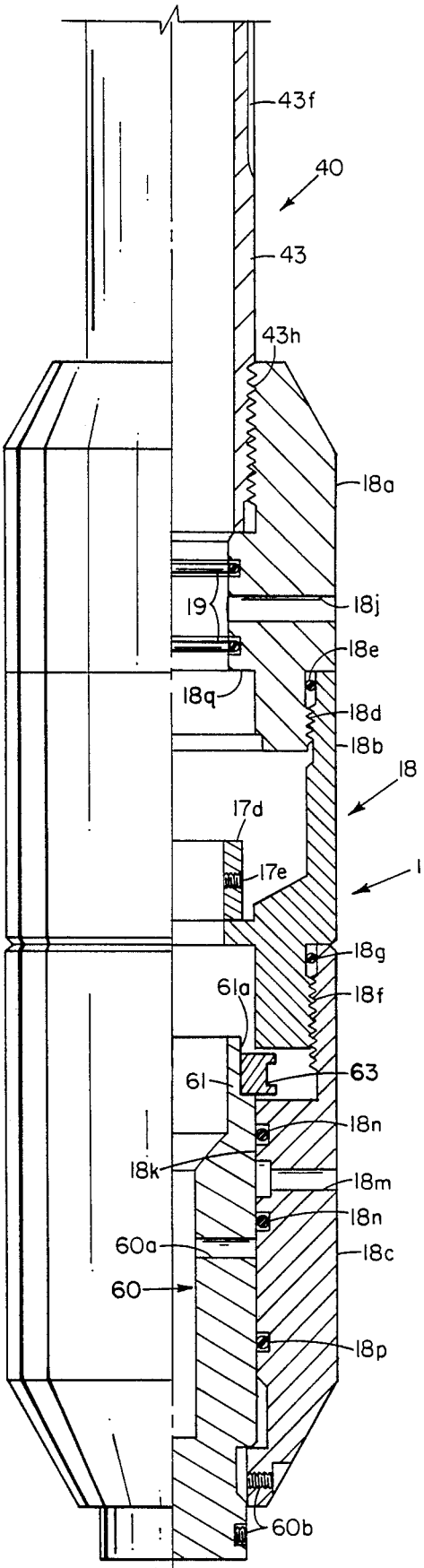
Figure 5B:
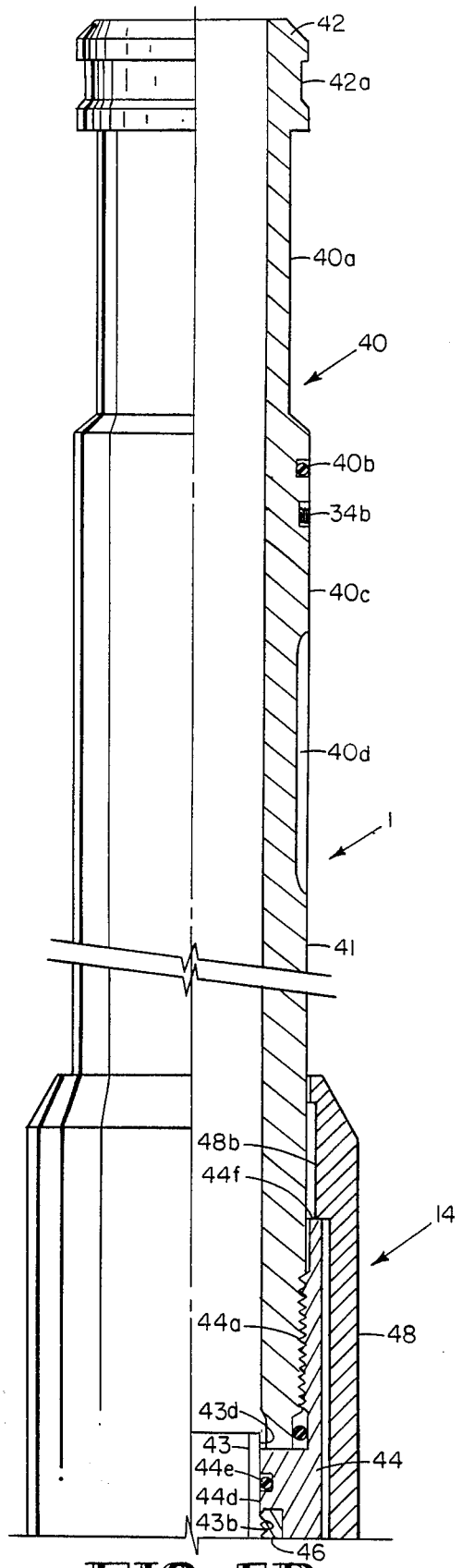
FIGS. 5B, 5C, 5D, 5E, and 5F are views respectively similar to FIGS. 4B, 4C, 4D, 4E, an 4F, but showing the upward movement of the primary mandrel to deflate the inflatable elements of the packing tool.
Figure 5C:
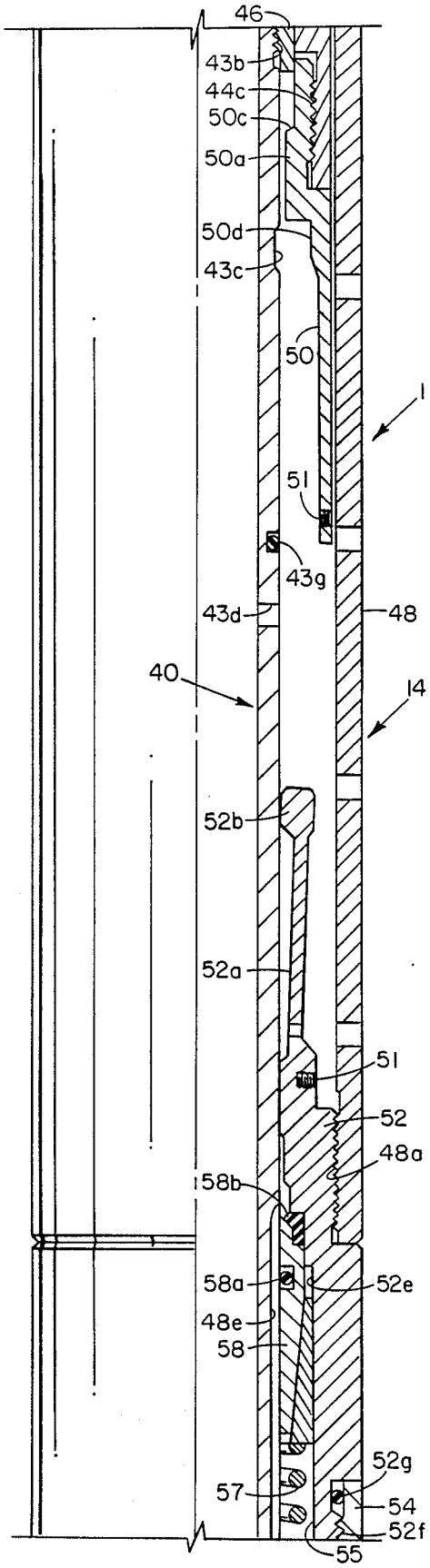
Figure 5D:
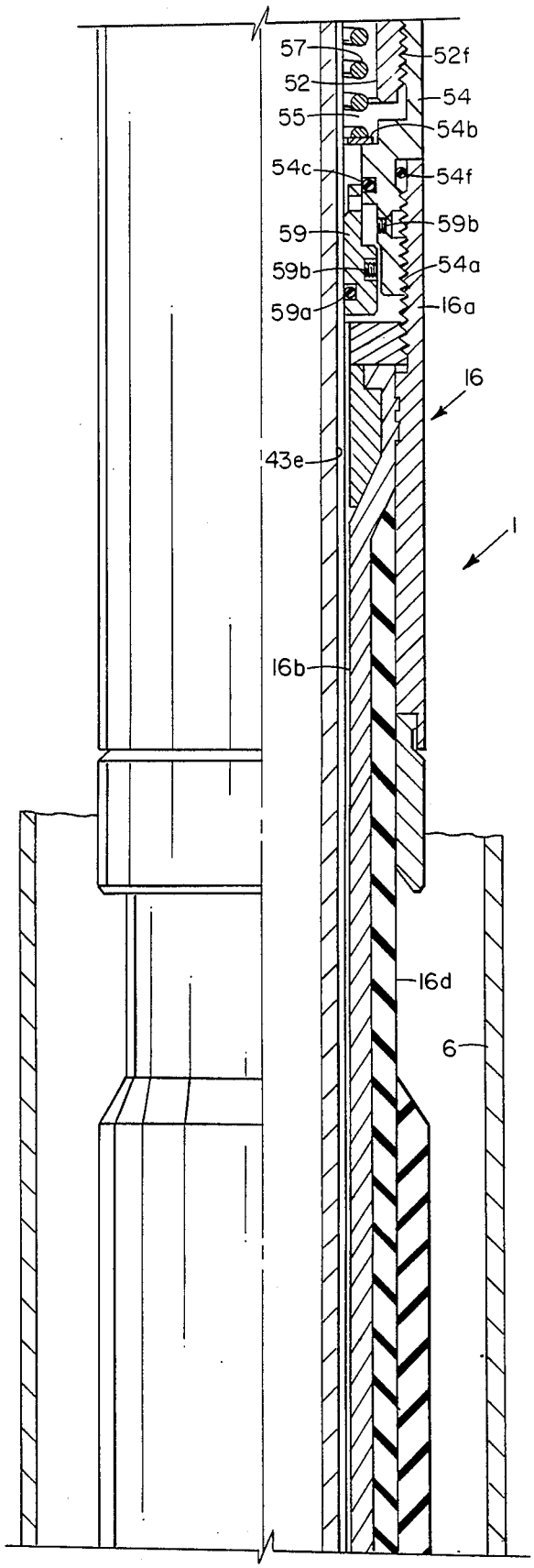
Figure 5E:
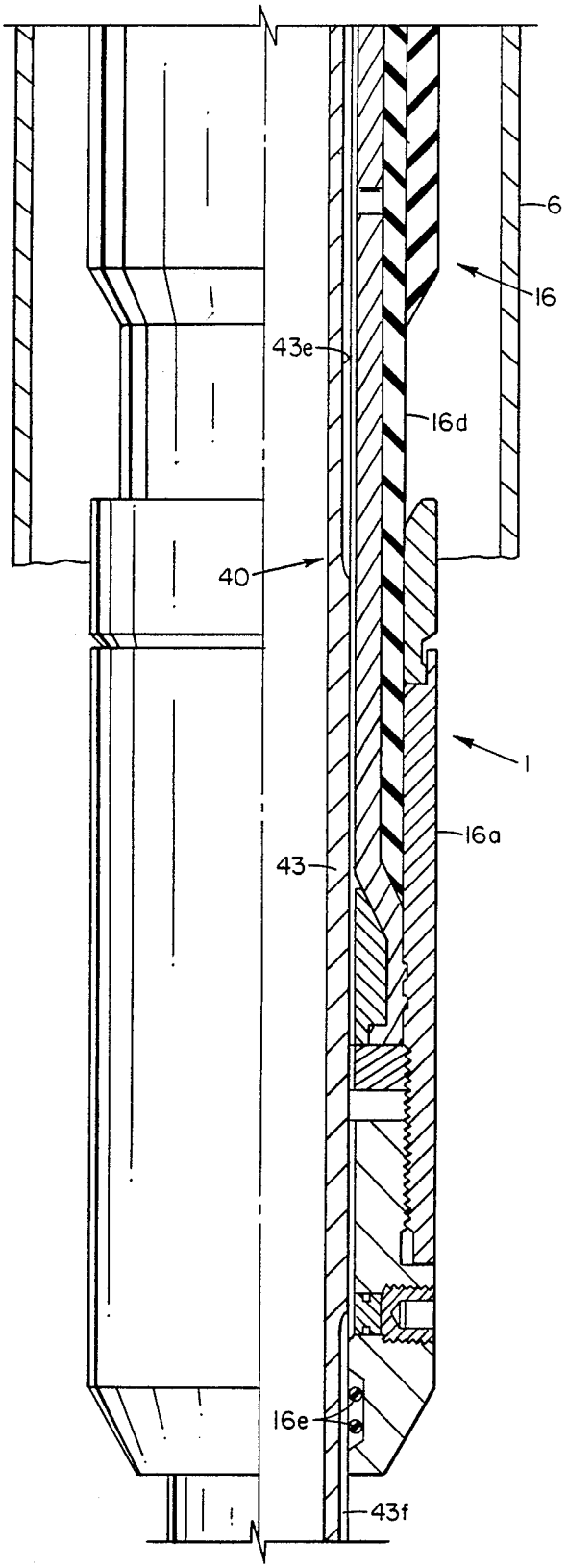
Figure 5F:
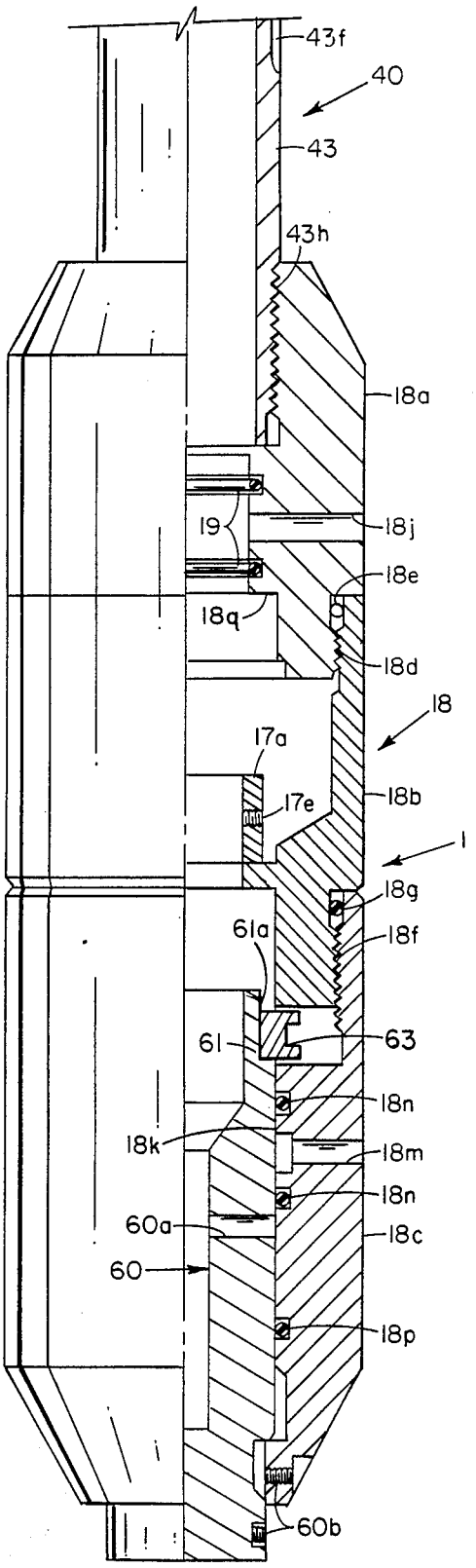

If the bridge plug is to remain in position for some period of time, it may be desirable to effect the removal of the remedial tubing and the upper connector subassembly 12. This is accomplished through the simple expedient of further increasing the fluid pressure supplied through the remedial tubing sufficient to effect the shearing of the piston shear screws 34*b*, thus permitting the piston 34 to be driven downwardly by the increased fluid pressure and hence releasing the collet heads 30*c* from engagement with the fishing head 42 provided on the top end of the upper part 41 of the primary mandrel 40. The remedial tubing 10 may then be retrieved from the well and it will carry with it the majority of the elements of the first connector subassembly 12, including the collet 30, the cylinder sleeve 32, and the piston 34 (see FIGS. 3A and 3B).

When it is desired to effect the removal of the tool 1 from the well, the fishing head 17*a* provided on the top of the secondary mandrel 17 is engaged by a conventional wireline tool and the secondary mandrel is pulled upwardly, thus shearably releasing the positioning ring 17*d*. When the end of the mandrel passes the ports 18*j* provided in the top portion 18*a* of the centralizer housing 18, the fluid pressures above and below the inflated packer are equalized and this is a very desirable preliminary step to be taken prior to attempting to deflate the inflated packer. The complete removal of the mandrel 17 from the well (FIGS. 4B–4F) ensures the operator that pressure equalization has been obtained and hence he can safely proceed with the deflation procedures.

The inflatable packer 16 is deflated by the operator engaging the fishing neck 42 provided on the top of upper portion 41 of the primary mandrel 40 by a wireline tool and exerting an upward pull on the primary mandrel 40. Such upward pull must be sufficient to effect the shearing of shear pins 51 which interconnect the collet locking sleeve 50 and the ring portion of the collet 52. Upon subsequent upward movement of the collet locking sleeve 50, as permitted by the lost motion connection between the upper portion 41 and the lower portion 43 of the primary mandrel 40, the collet heads 52*b* are released from engagement with the groove 43*c* and the lower portion 43 of the primary mandrel 40 is then free for upward movement.

Such upward movement brings the elongated grooves 43*e* and 43*f* in the lower part 43 of the primary mandrel 40 into bridging engagement respectively with the seals 58*a* and 16*e* which immediately releases the inflating pressure from the expanded elastomeric element 16*d*, permitting such element to collapse. Further upward movement of the primary mandrel 40 will bring the top suface 44*f* of the connecting sub 44 into engagement with the inwardly projecting portion 48*a* of the outer sleeve 48 and thus move the entire inflatable packing tool 16 upwardly for retrieval from the well through the small diameter tubing string 8 (FIGS. 5B–5F).

The structure of this invention, and particularly the utilization of a collet lock between the primary mandrel 40 and the body of the inflatable packer 16 may be employed in a packer construction. To effect such modification of the invention, it is only necessary to eliminate the secondary mandrel 17 and provide continuously open ports in the bottom end of the centralizer housing 18 so as to permit well fluids to pass into and out of the tool. The creation of a suitable inflation pressure is accomplished in the manner described in the above-identified parent Application through the utilization of a sleeve shearably mounted within the bore of the tool and defining an upwardly facing ball sealing surface upon which a ball may be seated to develop the required inflation pressure. The operation of the tool in this format is identical to that described in the aforementioned parent Application. When utilizing the above-described tool as a packer, the retrieval operation is effected by the remedial tubing but, with the elimination of large shear screws between the primary mandrel 40 and the body of the inflatable packer 16, there is little possibility that the forces involved in the retrieval operation will exceed the tensile strength of the remedial tubing.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An inflatable packing tool capable of being run in a subterannean well by a remedial tubing comprising, in combination, a radially expandable, tubular elastomeric element, a tubular body assemblage securing each end of said elastomeric element against radial expansion; an elongated mandrel inserted through said tubular body assemblage; axially spaced seal means in said tubular body cooperating with said mandrel in a first axial position of said mandrel to define an annular fluid pressure chamber having the unsecured medial portion of said elastomeric element as an outer wall; said mandrel having peripherally spaced, axially extending recesses in its exterior bypassing said seal means in a second axial position of said mandrel; means for connecting the top end of said mandrel to the bottom end of a remedial tubing for run-in; a collet secured to said tubular body assemblage and having latching heads operatively connected to said mandrel to secure said mandrel in said first position; means for supplying fluid pressure through the remedial tubing to said annular fluid pressure chamber to inflate said medial portion of said elastomeric element into sealing engagement with the well bore when said mandrel is in said first position; means for trapping said fluid pressure in said annular fluid pressure chamber, whereby upward fluid pressure forces on said mandrel are resisted by said collet; a latching sleeve telescopically engaging said collet latching heads to secure same in locking relation to said mandrel and having an upward lost motion connection with said mandrel, and means for elevating said latching sleeve to release said collet latching heads from said mandrel and raise said mandrel to said second axial position to deflate said elastomeric element.

2. The apparatus of claim 1 further comprising a fishing neck configuration on the top of said connecting means, permitting engagement by a wireline tool to elevate said latching sleeve and release said collet latching heads from said mandrel; said lost motion means connecting said sleeve and said mandrel to move said mandrel to said second axial position to bypass said seal means and deflate said elastomeric element, thereby permitting wireline retrieval of the entire tool.

3. The apparatus of claim 2 further comprising wireline operated means for equalizing fluid pressure above and below said inflated elastomeric element of said mandrel prior to deflation of said inflated elastomeric element.

4. The apparatus defined in claim 1, 2, or 3 further comprising an annular centralizer housing secured to the bottom end of said mandrel, at least one circulating port traversing the side wall of said centralizing housing; and fluid pressure operated valve means for concurrently closing the bore of said centralizer housing and said circulating port, whereby said packing tool functions as a bridge plug.

5. The apparatus defined in claim 1, 2, or 3 further comprising an annular centralizer housing secured to the bottom end of said mandrel, at least one circulating port traversing the side wall of said centralizing housing; a valve plug slidably and sealably mounted in the bore of said annular centralizer housing, thereby blocking the bore of said annular centralizer housing; radial port means in said valve plug alignable with said circulating port in one axial position of said valve plug, thereby permitting circulation; and means responsive to fluid pressure transmitted through said remedial tubing for shifting said valve plug to a position blocking said circulating port, whereby said packing tool functions as a bridge plug.

6. The apparatus defined in claim 1, 2, or 3 further comprising an annular centralizer housing secured to the bottom end of said mandrel, at least one circulating port traversing the side wall of said centralizing housing; a valve plug slidably and sealably mounted in the bore of said annular centralizer housing, thereby blocking the bore of said annular centralizer housing; radial port means in said valve plug alignable with said circulating port in one axial position of said valve plug, thereby permitting circulation; and means responsive to fluid pressure transmitted through said remedial tubing for shifting said valve plug to a position blocking said circulating port; and means for locking said plug valve in said blocking position relative to said circulating port, whereby said packing tool functions as a bridge plug.

7. The apparatus defined in claim 1, 2, or 3 further comprising an annular centralizer housing secured to the bottom end of said mandrel, at least one circulating port traversing the side wall of said centralizing housing; a valve plug slidably and sealably mounted in the bore of said annular centralizer housing, thereby blocking the bore of said annular cnetralizer housing; radial port means in said valve plug alignable with said circulating port in one axial position of said valve plug, thereby permitting circulation; a secondary mandrel telescopically extending through said mandrel and abutting said valve plug; said secondary mandrel having an annular ball seat to receive a sealing ball, whereby fluid pressure transmitted through said remedial tubing shifts said secondary mandrel and said valve plug downwardly to block said circulating port, whereby said packing tool functions as a bridge plug.

8. The apparatus defined in claim 1, 2, or 3 further comprising an annular centralizer housing secured to the bottom end of said mandrel, at least one circulating port traversing the side wall of said centralizing housing; a valve plug slidably and sealably mounted in the bore of said annular centralizer housing, thereby blocking the bore of said annular centralizer housing; radial port means in said valve plug alignable with said circulating port in one axial position of said valve plug, thereby permitting circulation; a secondary mandrel telescopically extending through said mandrel and abutting said valve plug; said secondary mandrel having an annular ball seat to receive a sealing ball, whereby fluid pressure transmitted through said remedial tubing shifts said secondary mandrel and said valve plug downwardly to block said circulating port; and means for locking said plug valve in said port blocking position, whereby said packing tool functions as a bridge plug.

9. The apparatus defined in claim 1 further comprising an annular centralizer housing secured to the bottom end of said mandrel, a first circulating port traversing the side wall of said centralizing housing; a valve plug slidably and sealably mounted in the bore of said annular centralizer housing, thereby blocking the bore of said annular centralizer housing; radial port means in said valve plug alignable with said first circulating port in one axial position of said valve, plug thereby permitting circulation; a secondary mandrel telescopically extending through said mandrel and abutting said valve plug; said secondary mandrel having an annular ball seat to receive a sealing ball, whereby fluid pressure transmitted through said remedial tubing shifts said secondary mandrel and said valve plug downwardly to block said first circulating port; means for locking said plug valve in said port blocking position; a second port traversing the wall of said annular centralizer housing at a location above said first circulating port; annular seal means above and below said second port cooperating with an external cylindrical surface on said secondary mandrel to block said second port; and means for raising said secondary mandrel to open said second port after inflation of said elastomeric element, thereby equalizing fluid pressures above and below the inflated elastomeric element.

10. The apparatus of claim 9 wherein said means for raising said secondary mandrel comprises a fishing neck on the top end of said secondary mandrel engagable by a wireline tool to retrieve said secondary mandrel from the well subsequent to retrieval of the remedial tubing.

11. The apparatus of claim 10 further comprising a fishing neck on the upper portion of said connecting means engagable by a wireline tool after retrieval of said secondary mandrel to raise said first mentioned mandrel to deflate said inflated elastomeric element and then retrieve said packing tool from the well.

12. An inflatable packing tool capable of being run-in and retrieved from a subterannean well by a remedial tubing comprising, in combination, a radially expandable, tubular elastomeric element, a tubular body assemblage securing each end of said elastomeric element against radial expansion; an elongated mandrel inserted through said tubular body; seal means in said tubular body assemblage cooperating with said mandrel in a first axial position of said mandrel to define an annular fluid pressure chamber having the unsecured medial portion of said elastomeric element as an outer wall; said mandrel having peripherally spaced, axially extending recesses in its exterior bypassing said seal means in a second axial position of said mandrel; a collet mounted on said tubular body assemblage and having peripherally spaced locking heads engagable with the exterior of said mandrel to secure same to said body in said first position; a collet locking sleeve engagable with said locking heads to prevent disengagement from said mandrel; means defining a lost motion connection between said collet locking sleeve and said mandrel, whereby initial upward movement of said locking sleeve releases said locking heads and then shifts said mandrel from said first to said second axial position; means for supplying fluid pressure through the remedial tubing to said annular fluid pressure chamber to inflate said medial portion of said elastomeric element into sealing engagement with the well bore when said mandrel is in said first position; means for trapping said fluid pressure in said annular fluid pressure chamber whereby upward fluid pressure forces on said mandrel are resisted by said collet; and means for elevating said collet locking sleeve to release said locking heads and shift said mandrel to said second position to deflate said expanded elastomeric element.

13. The apparatus of claim 12 further comprising means for equalizing fluid pressures above and below the expanded elastomeric element prior to shifting said mandrel to said second position.

14. The method of setting and retrieving a packing tool in a subterranean well casing partially traversed by a smaller diameter tubing string, comprising the steps of assembling an inflatable packer on an inflation control mandrel having axially spaced inflating and deflating positions relative to the inflatable packer, securing the inflation control mandrel in said inflating position by a collet on the inflatable packer; connecting the inflatable packer to a connector device having a detachable engagement with a remedial mandrel and an abutting connection with the collet to secure same in locking relation to said inflation control mandrel; lowering the inflatable packer on remedial tubing through the small diameter tubing string to position the inflatable packer at a desired location in the casing below the end of the small diameter tubing string; closing the bore of the inflation control mandrel; applying fluid pressure through the remedial tubing to inflate said inflatable packer into sealing engagement with the casing bore; and subsequently elevating the connector device for first, releasing the collet engagement with said inflation control mandrel, and then secondly, elevating the inflation control mandrel to its deflation position, thereby deflating the inflatable packer and then thirdly, retrieving the mandrel and deflated packer to the well surface through the small diameter tubing string.

15. The method of claim 14 further comprising the step of equalizing fluid pressure above and below the inflated packer prior to raising the inflation control mandrel to its deflating position.

16. The method of claim 14 further comprising the steps of maintaining a circulation passage through the wall of said inflation control mandrel in an open condition during runin; and closing said circulation passages prior to the application of fluid pressure to inflate said inflatable packer.

17. The method of setting and retrieving a packing tool in a subterranean well casing partially traversed by a smaller diameter tubing string, comprising the steps of assembling an inflatable packer on an inflation control mandrel having axially spaced inflating and deflating positions relative to the inflatable packer; securing the inflation control mandrel in said inflating position by a collet on the inflatable packer; shearably connecting the inflatable packer to a connector device having a detachable engagement with a remedial tubing, a lost motion connection to the inflation control mandrel and an abutting connection with the collet to secure same in locking relation to said inflation control mandrel; lowering the inflatable packer on remedial tubing through the small diameter tubing string to position the inflatable packer at a desired location in the casing below the end of the small diameter tubing string; closing the bore of the inflation control mandrel; applying fluid pressure through the remedial tubing to inflate said inflatable packer into sealing engagement with the casing bore; subsequently applying additional fluid pressure to release the connector device from the remedial tubing; retrieving the remedial tubing and exposing the upper end of the connector device; engaging the exposed upper end of the connector device by a wireline means; and subsequently elevating the connector device for first releasing the collet engagement with said inflation control mandrel, then secondly, elevating the inflation control mandrel to its deflation position, thereby deflating the inflatable packer and then thirdly, retrieving the mandrel and deflated packer to the wall surface through the small diameter tubing string.

18. The method of claim 17 further comprising the step of equalizing fluid pressure above and below the inflated packer prior to raising the inflation control mandrel to its deflating position.

19. The method of claim 17 further comprising the steps of maintaining a circulation passage through the wall of said inflation control mandrel in an open condition during run-in; and closing said circulation passage prior to the application of fluid pressure to inflate said inflatable packer.

* * * * *